US012270293B2

(12) United States Patent
Wingstrom et al.

(10) Patent No.: US 12,270,293 B2
(45) Date of Patent: Apr. 8, 2025

(54) POSITION SENSOR, METHOD AND SYSTEM

(71) Applicant: Baker Hughes Oilfield Operations LLC, Houston, TX (US)

(72) Inventors: Luke Wingstrom, Spicewood, TX (US); David Bishop, Cypress, TX (US); Shane Harris, Cypress, TX (US); Marc Samuelson, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/359,957

(22) Filed: Jul. 27, 2023

(65) Prior Publication Data

US 2024/0102382 A1 Mar. 28, 2024

Related U.S. Application Data

(60) Provisional application No. 63/409,440, filed on Sep. 23, 2022.

(51) Int. Cl.
*E21B 47/09* (2012.01)

(52) U.S. Cl.
CPC ..... *E21B 47/09* (2013.01)

(58) Field of Classification Search
CPC ..... E21B 17/028; E21B 47/09
See application file for complete search history.

(56) References Cited

U.S. PATENT DOCUMENTS 4,073,562 A * 2/1978 Karlskind ..... H01R 13/523 439/271
4,921,438 A * 5/1990 Godfrey ..... E21B 23/14 439/190
5,332,048 A * 7/1994 Underwood ..... E21B 44/005 175/26
5,468,153 A * 11/1995 Brown ..... E21B 17/0285 439/840
9,988,894 B1 6/2018 Malone et al.
2005/0070141 A1* 3/2005 Dopf ..... H01R 13/4538 439/140

(Continued)

FOREIGN PATENT DOCUMENTS

JP 2010532452 A 10/2010

OTHER PUBLICATIONS

Notification of Transmittal of the International Search Report and the Written Opinion of the International Searching Authority, or the Declaration; PCT/US2023/030472; Mail date Nov. 23, 2023; 10 pages.

*Primary Examiner* — Shane Bomar
(74) *Attorney, Agent, or Firm* — Baker Hughes Patent Organization

(57) ABSTRACT

A position sensor and a position sensor system, including a feeler, a force transfer element operably connected to the feeler, a force receiver operably connected to the force transfer element, and a force quantifier operably connected to the force receiver. A method for sensing position of a wet connector in a downhole environment, including running a position sensor on an upper wet connector to a target location, contacting a feeler block location on a lower wet connector, stroking the feeler, receiving a force at the force receiver, and communicating the received force to the force quantifier. A borehole system including a borehole in a subsurface formation, a position sensor disposed in the borehole.

18 Claims, 3 Drawing Sheets

(56) References Cited

U.S. PATENT DOCUMENTS

| | | | | |
|---|---|---|---|---|
| 2011/0079400 | A1* | 4/2011 | Algeroy | E21B 17/0283 166/65.1 |
| 2012/0013482 | A1 | 1/2012 | Patel et al. | |
| 2013/0098632 | A1* | 4/2013 | Wetzel | E21B 43/128 166/85.1 |
| 2017/0089496 | A1 | 3/2017 | Lennon | |
| 2018/0340875 | A1 | 11/2018 | Norwood et al. | |
| 2020/0080388 | A1* | 3/2020 | Leismer | E21B 47/008 |
| 2021/0140247 | A1* | 5/2021 | Bishop | E21B 17/028 |

* cited by examiner

POSITION SENSOR, METHOD AND SYSTEM

CROSS REFERENCE TO RELATED APPLICATIONS

This application claims the benefit of an earlier filing date from U.S. Provisional Application Ser. No. 63/409,440 filed Sep. 23, 2022, the entire disclosure of which is incorporated herein by reference.

BACKGROUND

In the resource recovery and fluid sequestration industries there is often need to make wet connects. This requires procedures to ensure a proper connection. Many procedures such as fluid flushing are quite effective but unless a connection is completed and the connection itself is evident in some way at surface, it is hard to know whether and what remedial action is needed. The art always is receptive to additional information about operations in the downhole environment.

SUMMARY

An embodiment of a position sensor, including a feeler, a force transfer element operably connected to the feeler, a force receiver operably connected to the force transfer element, and a force quantifier operably connected to the force receiver.

A method for sensing position of a wet connector in a downhole environment, including running a position sensor on an upper wet connector to a target location, contacting a feeler block location on a lower wet connector, stroking the feeler, receiving a force at the force receiver, and communicating the received force to the force quantifier.

An position sensor system including a housing, a bore disposed within the housing, a ambient pressure port in the housing fluidly connected to the bore, a force transfer element disposed in the bore and exposed to ambient fluid pressure, a force receiver disposed in the bore and responsive to contact with the force transfer element, a feeler disposed through the housing and in operable contact with the force transfer element, and a force quantifier in operable contact with the force receiver.

An embodiment of a borehole system including a borehole in a subsurface formation, a position sensor disposed in the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
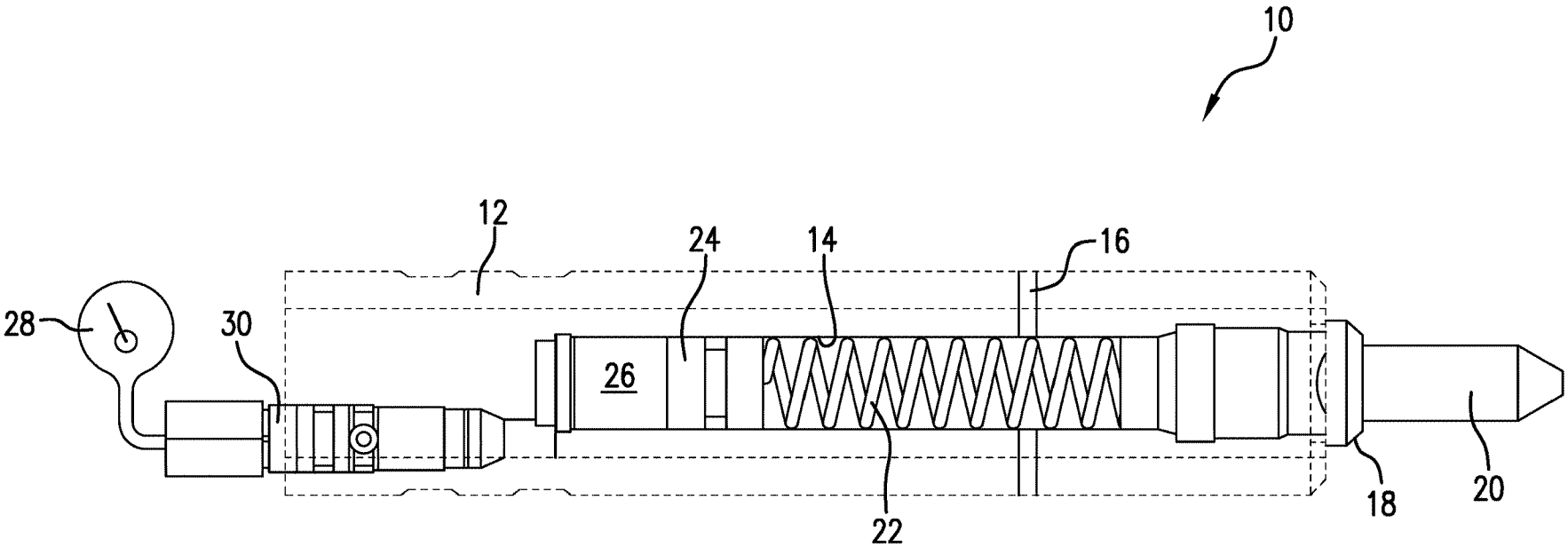
FIG. 1 is a cross sectional view of a position sensor as disclosed herein.

Referring to FIG. 1, a position sensor 10 is illustrated. The sensor 10 includes a housing 12 having a bore 14 therein and having an ambient pressure port 16 that supplies ambient pressure to the bore 14. At an end of the bore 14 is disposed a feeler housing 18 with a feeler 20 movably retained therein. The feeler 20 may cycle from the position illustrated in FIG. 1 to a position where more of the feeler 20 is resident within the bore 14 of the housing 12. This would be occasioned by the feeler 20 coming into contact with another structure with sufficient energy to move the feeler 20 into the housing 12. In an embodiment contemplated, stroke length of the feeler is about 0.5 inches. It is to be appreciated however, that other stroke lengths are contemplated and possible with the construction of the sensor 10 as disclosed herein. Disposed within the bore 14 and in operable communication with the feeler 20 is a force transfer element 22. The purpose of the element 22 is to transfer force encountered at the feeler 20 to a force receiver 24 also resident within the bore 14. While the element 22 may be an extension of the feeler 20 without significant resilience such as a metal rod, this embodiment would limit effective stroke length. In another embodiment, the element 22, if configured as a resilient member, such as a spring, can enable a greater stroke length. The force may be transferred to the force receiver 24 based upon the K constant of the spring rather than an incompressible transfer element such as the rod mentioned above. Greater stroke length improves reliability in position sensing. In an embodiment, the spring may be a coil spring, although other resilient configurations are contemplated.

The force receiver 24 may be mobile within the bore 14 or may be fixed therein depending upon mode of operation of the force receiver 24. One mode of operation is for the force receiver 24 to be constituted as a piston that is translatable in the bore 14. In this embodiment, force transmitted to the force receiver 24 from the feeler 20 is directed into a hydraulic fluid in volume 26. The hydraulic fluid is ported to a force quantifier 28 that may be local to or remote from the sensor 10. The quantifier may in some embodiments be a pressure gauge. The illustration of quantifier 28 is meant to convey that the quantifier 28 may be located in a local or distant location. Hydraulic fluid is contained from volume 26 to the quantifier 28 through a control line 30. In a particular configuration of this embodiment, ½" stroke of the feeler 20 is transferred through element 22 using its selected K spring constant to produce a 35 PSI pressure delta in the quantifier 28. Note that the delta P is related only to the element 22 since the port 16 ensures that hydrostatic pressure is balanced against the pressure of hydraulic fluid in volume 26 and removed from the equation. Greater or lesser strokes are contemplated as well as greater or lesser pressure deltas. Spring constant K may also be adjusted as desired during construction to tailor the stroke and output responses.

Alternatively, the force receiver 24 may be fixed in position within the bore 14 and be configured as a load cell. The load cell should be one that is impervious to downhole fluids since it is open to such fluids through port 16. The load cell will report via electric signal to the quantifier 28, a graded range of load. In such an embodiment the quantifier 28 may be an electronic transceiver. Therefore, from zero load to a preset max load, that is related to stroke of feeler 20 and the spring constant K, one can calculate whether or not the position of sensor 10 is the desired one or is short of the desired position.

Figure 2:
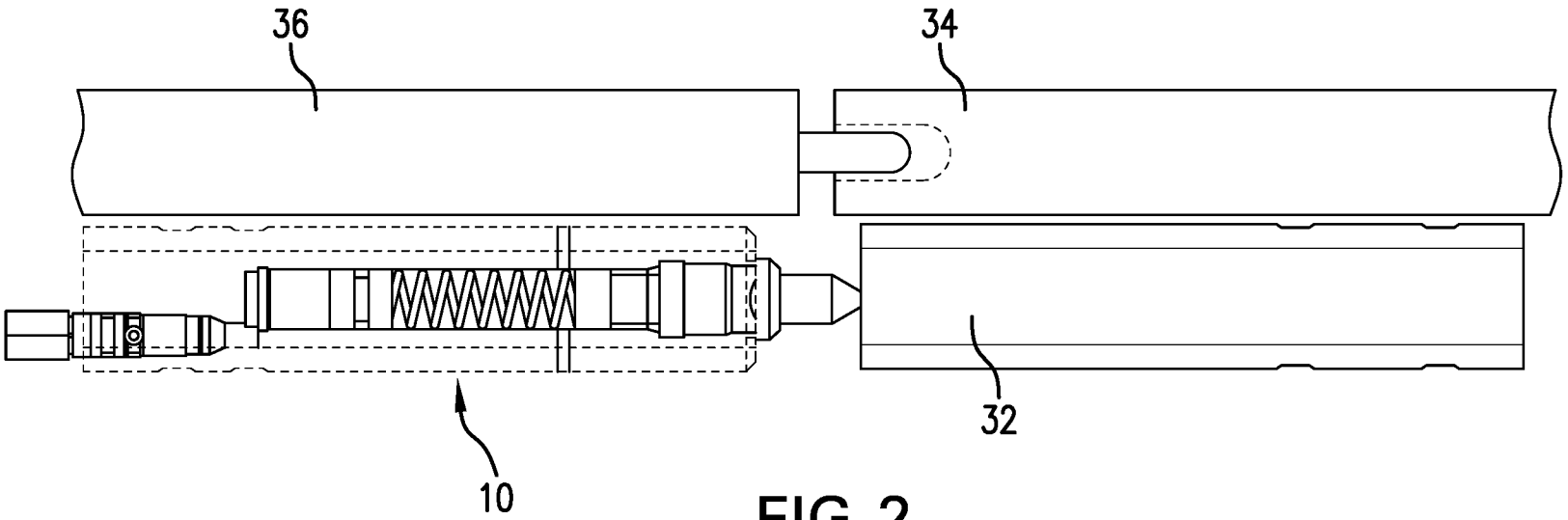
FIG. 2 is the FIG. 1 view in addition to a block with which the position sensor comes into contact when in use.

Referring to FIG. 2, a schematic illustration of the sensor 10 operation adds a block 32 to the illustration of FIG. 1. The block 32 may be any portion of a separate structure 34, such as a lower wet connector, with which a portion of a tool 36, such as an upper wet connector (of which the sensor 10 forms a part) is intended to make contact. Other tools are also contemplated. Those of skill in the art will recognize that a lower wet connector would be already disposed in a borehole and the upper wet connector would be subsequently run into the borehole to make up with the lower wet connector. Connection might be for hydraulics, electric, fiber etc. It is important that the connection is fully made to improve reliability. Heretofore, there has never been a way to know whether the wet connect parts are fully connected. The sensor 10 as disclosed herein provides much needed information regarding the position of the upper wet connect relative to the lower set connect by having the feeler 20 make contact with the block 32 and stroke the feeler 20 (astute observers will note that the position of feeler 20 in FIG. 1 vs FIG. 2, is indicative of at least a partial stroke of feeler 20). Whether the piston embodiment or the load cell embodiment or other equivalent configurations, the amount of stroke is communicated to an operator in various known ways such as electrically, acoustically, by fiber, etc. and a solid data point about how connected the two parts are is obtained.

A method for sensing a position of the upper wet connector 36 in the downhole environment relative to the lower wet connector 34 includes running the sensor 10 into contact with block 32. Further, the method comprises stroking the feeler 20 as much as is possible, considering what might be an impediment. For example, debris may have accumulated on the connector 34 that is in the way of a complete connection. The method continues by transferring force from the stroked feeler 20 through element 22 to the force receiver 24 and conveying a signal to the force quantifier 28. If only a portion of the design point stroke of the feeler 20 is reported at the force quantifier 28, then a full connection has not been achieved. Conversely, if the quantifier does report the expected pressure change or electronic load, then full connection is achieved.

Figure 3:
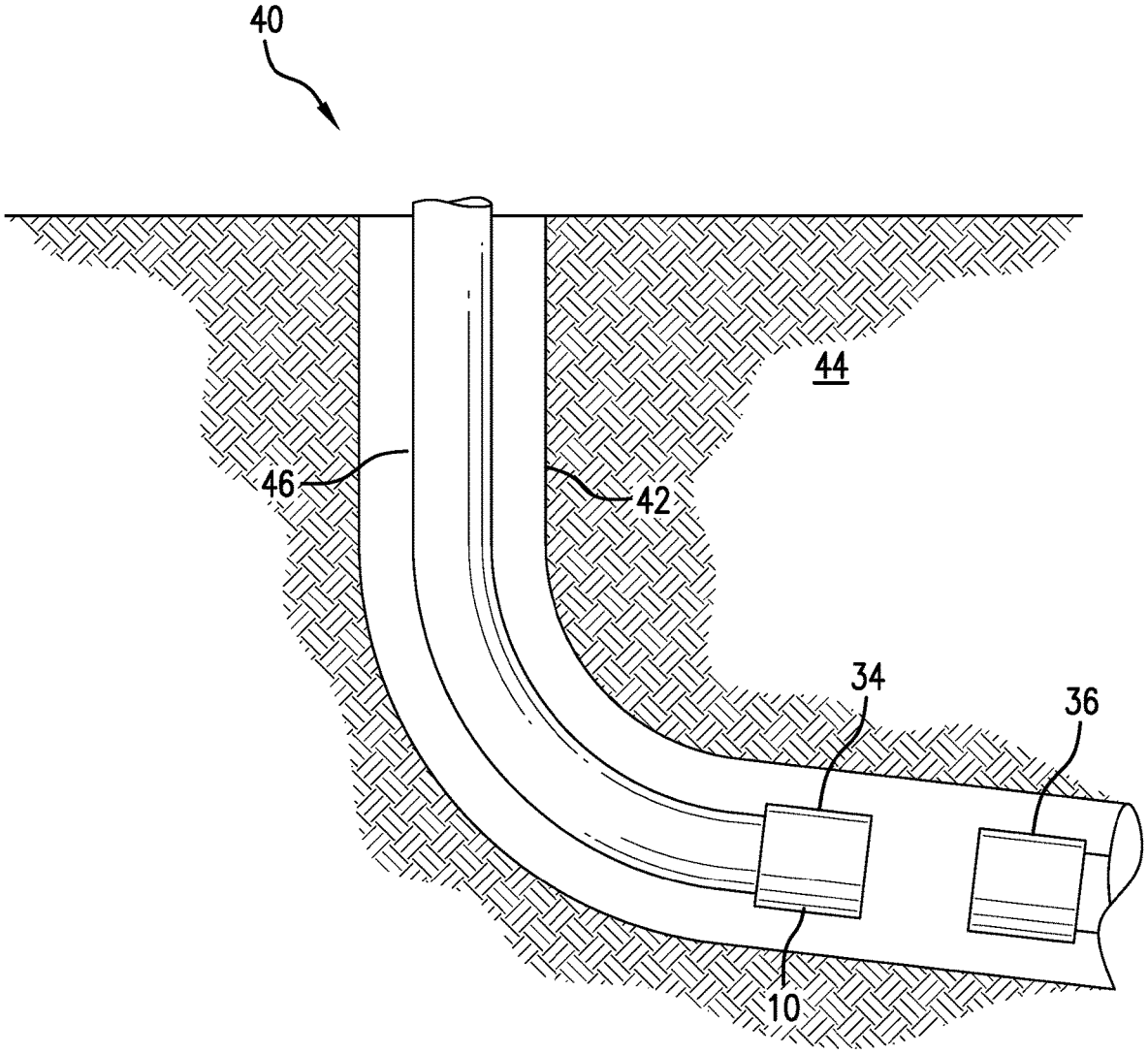
FIG. 3 is a view of a borehole system including the position sensor as disclosed herein.

Referring to FIG. 3, a borehole system 40 is illustrated. The system 40 comprises a borehole 42 in a subsurface formation 44. A string 46 is disposed in the borehole 42. The sensor 10 as described herein is disposed within or as a part of the string 46.

Set forth below are some embodiments of the foregoing disclosure:

Embodiment 1: A position sensor, including a feeler, a force transfer element operably connected to the feeler, a force receiver operably connected to the force transfer element, and a force quantifier operably connected to the force receiver.

Embodiment 2: The sensor as in any prior embodiment, wherein the feeler is a pin.

Embodiment 3: The sensor as in any prior embodiment, wherein the force transfer element is a spring.

Embodiment 4: The sensor as in any prior embodiment, wherein the spring is a coil spring.

Embodiment 5: The sensor as in any prior embodiment, wherein the force receiver is a piston.

Embodiment 6: The sensor as in any prior embodiment, wherein the force receiver is a load cell.

Embodiment 7: The sensor as in any prior embodiment, wherein the force quantifier is a pressure gauge fluidically connected to the force receiver.

Embodiment 8: The sensor as in any prior embodiment, wherein the force quantifier is electrically connected to the force receiver.

Embodiment 9: The sensor as in any prior embodiment, further including a housing that defines a bore.

Embodiment 10: The sensor as in any prior embodiment, wherein the bore houses the force receiver.

Embodiment 11: The sensor as in any prior embodiment, wherein the receiver is movable within the bore.

Embodiment 12: The sensor as in any prior embodiment, wherein the receiver separates wellbore fluid from hydraulic fluid when in use.

Embodiment 13: The sensor as in any prior embodiment, wherein the receiver is fixed within the bore.

Embodiment 14: A method for sensing position of a wet connector in a downhole environment, including running a position sensor as in any prior embodiment on an upper wet connector to a target location, contacting a feeler block location on a lower wet connector, stroking the feeler, receiving a force at the force receiver, and communicating the received force to the force quantifier.

Embodiment 15: The method as in any prior embodiment, further comprising moving the force receiver with the force transfer element.

Embodiment 16: The method as in any prior embodiment, further including pressurizing a hydraulic fluid by the moving of the force receiver.

Embodiment 17: The method as in any prior embodiment, further including compressing the force transfer element.

Embodiment 18: A position sensor system including a housing, a bore disposed within the housing, a ambient pressure port in the housing fluidly connected to the bore, a force transfer element disposed in the bore and exposed to ambient fluid pressure, a force receiver disposed in the bore and responsive to contact with the force transfer element, a feeler disposed through the housing and in operable contact with the force transfer element, and a force quantifier in operable contact with the force receiver.

Embodiment 19: The system as in any prior embodiment, further comprising a lower wet connect configured to interact with an upper wet connect of which the housing forms a part.

Embodiment 20: A borehole system including a borehole in a subsurface formation, a position sensor as in any prior embodiment disposed in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A position sensor, comprising:
a feeler;
a force transfer element operably connected to the feeler;
a force receiver operably connected to the force transfer element; and
a force quantifier operably connected to the force receiver, wherein the force quantifier is electrically connected to the force receiver.

2. The sensor as claimed in claim 1, wherein the feeler is a pin.

3. The sensor as claimed in claim 1, wherein the force transfer element is a spring.

4. The sensor as claimed in claim 3, wherein the spring is a coil spring.

5. The sensor as claimed in claim 1, wherein the force receiver is a piston.

6. The sensor as claimed in claim 1, wherein the force receiver is a load cell.

7. The sensor as claimed in claim 1, wherein the force quantifier is a pressure gauge fluidically connected to the force receiver.

8. The sensor as claimed in claim 1, further including a housing that defines a bore.

9. The sensor as claimed in claim 8, wherein the bore houses the force receiver.

10. The sensor as claimed in claim 9, wherein the receiver is movable within the bore.

11. The sensor as claimed in claim 10, wherein the receiver separates wellbore fluid from hydraulic fluid when in use.

12. The sensor as claimed in claim 9, wherein the receiver is fixed within the bore.

13. A method for sensing position of a wet connector in a downhole environment, comprising:
running a position sensor as, comprising:
a feeler;
a force transfer element operably connected to the feeler;
a force receiver operably connected to the force transfer element; and
a force quantifier operably connected to the force receiver
on an upper wet connector to a target location;
contacting a feeler block location on a lower wet connector;
stroking the feeler;
receiving a force at the force receiver; and
communicating the received force to the force quantifier.

14. The method as claimed in claim 13, further comprising moving the force receiver with the force transfer element.

15. The method as claimed in claim 14, further including pressurizing a hydraulic fluid by the moving of the force receiver.

16. The method as claimed in claim 14, further including compressing the force transfer element.

17. A position sensor system comprising:
a housing;
a bore disposed within the housing;
an ambient pressure port in the housing fluidly connected to the bore;
a force transfer element disposed in the bore and exposed to ambient fluid pressure;
a force receiver disposed in the bore and responsive to contact with the force transfer element;
a feeler disposed through the housing and in operable contact with the force transfer element;
a force quantifier in operable contact with the force receiver and further comprising a lower wet connect configured to interact with an upper wet connect of which the housing forms a part.

18. A borehole system comprising:
a borehole in a subsurface formation;
a position sensor comprising:
a feeler;
a force transfer element operably connected to the feeler;
a force receiver operably connected to the force transfer element; and
a force quantifier operably connected to the force receiver
disposed in the borehole.

* * * * *